US005536025A

United States Patent [19]

Landay

[11] Patent Number: 5,536,025

[45] Date of Patent: Jul. 16, 1996

[54] IN-LINE WHEELED SKATE

[75] Inventor: David L. Landay, Boston, Mass.

[73] Assignee: Seneca Sports, Inc., Milford, Mass.

[21] Appl. No.: 356,903

[22] Filed: Dec. 15, 1994

[51] Int. Cl.[6] ..... A63C 17/04

[52] U.S. Cl. ..... 280/11.22; 280/11.27; 280/11.28

[58] Field of Search ..... 280/11.2, 11.22, 280/11.23, 11.27, 11.28, 87.041

[56] References Cited

U.S. PATENT DOCUMENTS

| | | | |
|---|---|---|---|
| 2,726,873 | 12/1955 | Wooley | 280/11.28 |
| 3,087,739 | 4/1963 | Ware | 280/11.28 |
| 3,963,252 | 6/1976 | Carlson | 280/11.22 |
| 4,403,784 | 9/1983 | Gray | 280/11.28 |
| 4,666,168 | 5/1987 | Hamill et al. | 280/11.2 |
| 4,711,458 | 12/1987 | Shim | 280/11.22 |
| 4,909,523 | 3/1990 | Olson | 280/11.2 |
| 5,028,058 | 7/1991 | Olson | 280/11.22 |
| 5,048,848 | 9/1991 | Olson et al. | 280/11.22 |
| 5,068,956 | 12/1991 | Malewicz | 29/437 |
| 5,092,614 | 3/1992 | Malewicz | 280/11.22 |
| 5,190,301 | 3/1993 | Malewicz | 280/11.22 |
| 5,277,437 | 1/1994 | Moats | 280/11.23 |
| 5,330,208 | 7/1994 | Charron et al. | 280/11.22 |

*Primary Examiner*—Richard M. Camby
*Attorney, Agent, or Firm*—Fish & Richardson

[57] ABSTRACT

An in-line wheeled skate has a frame with opposed, parallel side rails and wheel arranged in tandem between the side rails, each wheel mounted on an axle. Each axle end is surrounded and supported by a resilient element in a cushioning aperture of the side rail. Each axle end also extends into a guiding aperture of the side rail overlapping the cushioning aperture. The guiding aperture has a first dimension selected relative to a corresponding first dimension of the axle end to limit movement of the axle end relative to the side rail in the direction of a first plane, and a second dimension selected relative to a corresponding second dimension of the axle end to permit resilient movement of the axle end relative to the side rail in the direction of a second plane transverse to the first plane.

17 Claims, 4 Drawing Sheets

IN-LINE WHEELED SKATE

BACKGROUND OF THE INVENTION

It has been known to provide both truck skates and in-line or tandem skates with cushioned or resilient mounting between the wheels and frame in order to absorb at least a portion of the shock received by the wheels in travel over an irregular surface.

For example, for cushioning standard roller or truck skates, Gray U.S. Pat. No. 4,403,784 describes a frame with eccentric cushioning members having wheel axle receiving apertures closer to the lower end; Ware U.S. Pat. No. 3,087,739 describes skate wheels mounted to the frame by an axle extending through a pair of circular cushions; and Wooley U.S. Pat. No. 2,726,873 describes a skate having trucks attached to the frame via cushioning blocks.

For cushioning tandem or in-line skates, Moats U.S. Pat. No. 5,277,437 describes a frame with a slot for movement of the end of a wheel axle mounted between, e.g., a pair of opposed compression springs. The patent specification suggests that the angular position of the slot is adjustable by rotation of the slot portion within the sleeve, and that the spring compression is adjustable by means of screws shown extending through the sleeve; Charron et al. U.S. Pat. No. 5,330,208 describes a wheel axle with opposite ends mounted in eccentric slots in the frame, pressed towards the lower ends of the slots by compression springs; Carlson U.S. Pat. No. 3,963,252 describes a compression spring suspension mounted in the frame, which presses the opposite ends of the wheel axle toward the lower end of opposed slots; Moats (mentioned above) and Hammill et al. U.S. Pat. No. 4,666,168 both describe use of a resilient axle sleeve and/or resilient bearing sleeves provided to allow shifting movement of the wheel, e.g. during turning; and Shim U.S. Pat. No. 4,711,458 describes a skate frame supported upon the wheel axle bearings by arcuate dampening pads.

SUMMARY OF THE INVENTION

According to the invention, an in-line wheeled skate comprises a frame having a first side rail and a second side rail opposed and generally parallel to the first side rail, a plurality of wheels arranged in tandem between the side rails, a plurality of axles, each axle having a first end surrounded and supported by a first resilient element disposed in a first cushioning aperture defined by the first side rail, and each axle having an opposite, second end surrounded and supported by a second resilient element disposed in a second cushioning aperture defined by the second side rail, each wheel being supported upon a corresponding axle for rotation about a central axis of the wheel, the first side wall defining a first guiding aperture overlapping the first cushioning aperture, the first axle end extending into the first guiding aperture, the first guiding aperture having a first aperture dimension in a first plane of the central axis and a second aperture dimension in a second plane of the central axis transverse to the first plane, the first axle end having a first axle dimension in the first plane and a second axle dimension in the second plane, the first axle dimension being selected relative to the first aperture dimension to restrict movement of the first axle end in a direction of the first plane, and the second axle dimension being selected relative to the second aperture dimension to permit resilient movement of the first axle end in a direction of the second plane, the second side wall defining a second guiding aperture overlapping the second cushioning aperture, the second axle end extending into the second guiding aperture, the second guiding aperture having a first aperture dimension in a first plane of the central axis and a second aperture dimension in a second plane of the central axis transverse to the first plane, the second axle end having a first axle dimension in the first plane and a second axle dimension in the second plane, the first axle dimension being selected relative to the first aperture dimension to restrict movement of the second axle end in the first plane, and the second axle dimension being selected relative to the second aperture dimension to permit resilient movement of the second axle end in the second plane.

Preferred embodiments of this aspect of the invention may include one or more of the following additional features. The first plane is generally horizontal and generally parallel to a surface of travel. The second plane is transverse to, and preferably vertical and perpendicular to, the first plane. The axle comprises end caps mounted upon the axle ends, each end cap comprising a cap head defining a surface disposed for engagement with the side rail in a region of the guiding aperture, the cap head defining the first axle dimension and the second axle dimension. Preferably, the end cap comprises a sleeve mounted upon the axle end and a head extending radially from the sleeve. More preferably, the head of the end cap has a general form of a cylinder with opposite, parallel flats extending axially, each head disposed generally at an axle end within a region of a guiding aperture. For at least one guiding aperture, the second aperture dimension in the second plane is greater than a parallel dimension of the cushioning aperture. Preferably, at least one guiding aperture and/or at least one cushioning aperture is centered about the central axis. Each resilient element comprises a bushing, preferably formed of synthetic rubber or plastic, having a general form of an elongated cylinder with opposite, parallel flats extending axially, the bushing being disposed about each axle end within a region of the respective cushioning apertures. Each wheel comprises a wheel hub, a wheel body mounted on the hub and defining a tread for engagement with a travel surface, and one or more bearings disposed generally between the hub and the axle. For at least one guiding aperture, the first aperture dimension in the second plane is generally equal to a parallel dimension of the first cushioning aperture.

Objectives of this invention include to provide an in-line wheeled skate with a system for dampening and absorbing shock applied through the wheels of the skate by travel over an irregular surface. Further objectives include to provide a system of cushioning by which opposite ends of the wheel axle are surrounded and supported by resilient elements disposed in apertures defined by the frame side rails, with the axle ends limited from movement in a first plane and permitted to move resiliently in second plane in a manner to absorb shock and bumps.

These and other features and advantages of the invention will be apparent from the following description of a presently preferred embodiment, and from the claims.

DESCRIPTION OF THE PREFERRED EMBODIMENTS

Figure 1:
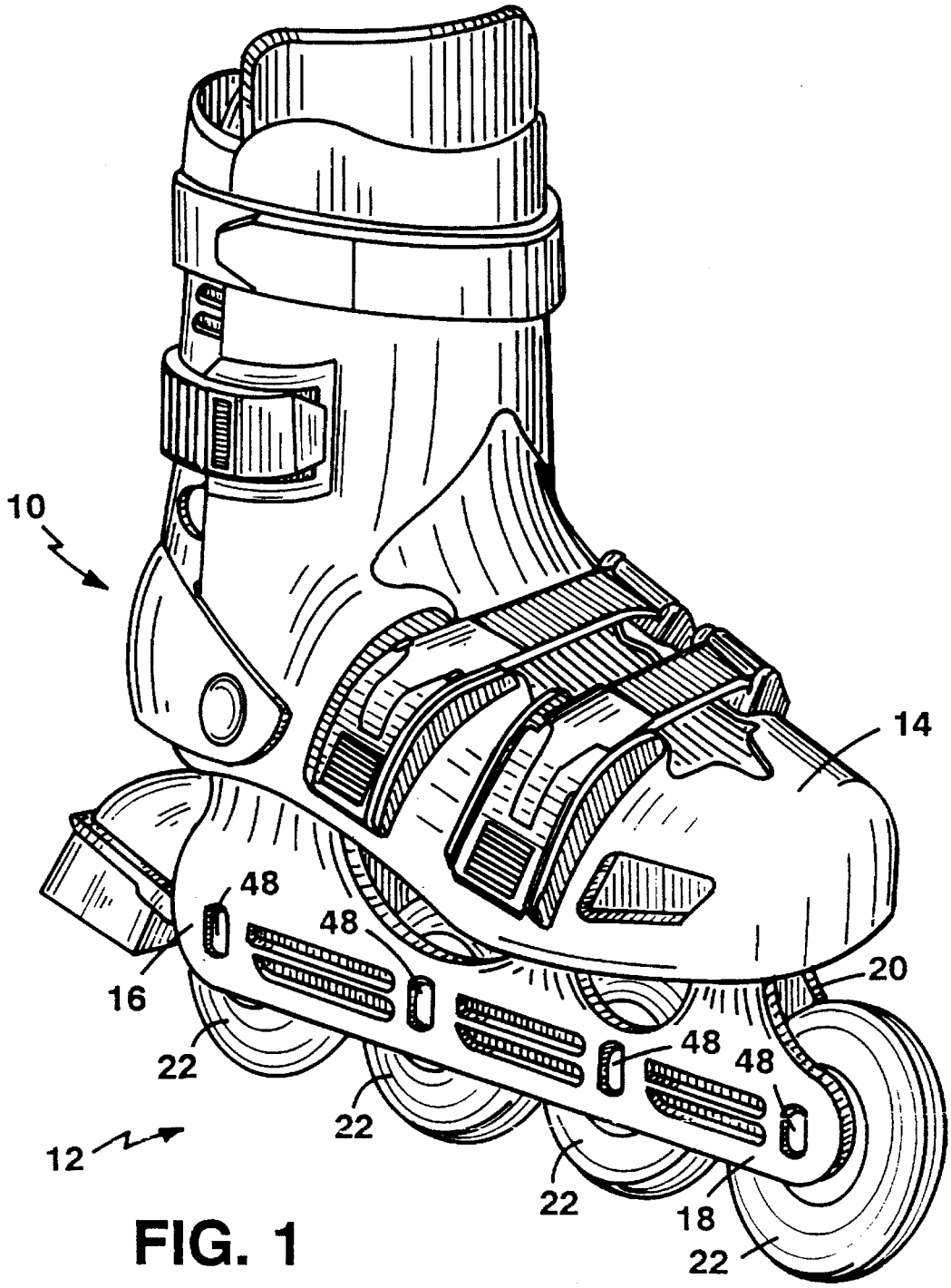
FIG. 1 is a perspective view of an in-line wheeled skate equipped with a shock absorbing system of the invention.
Figure 2:
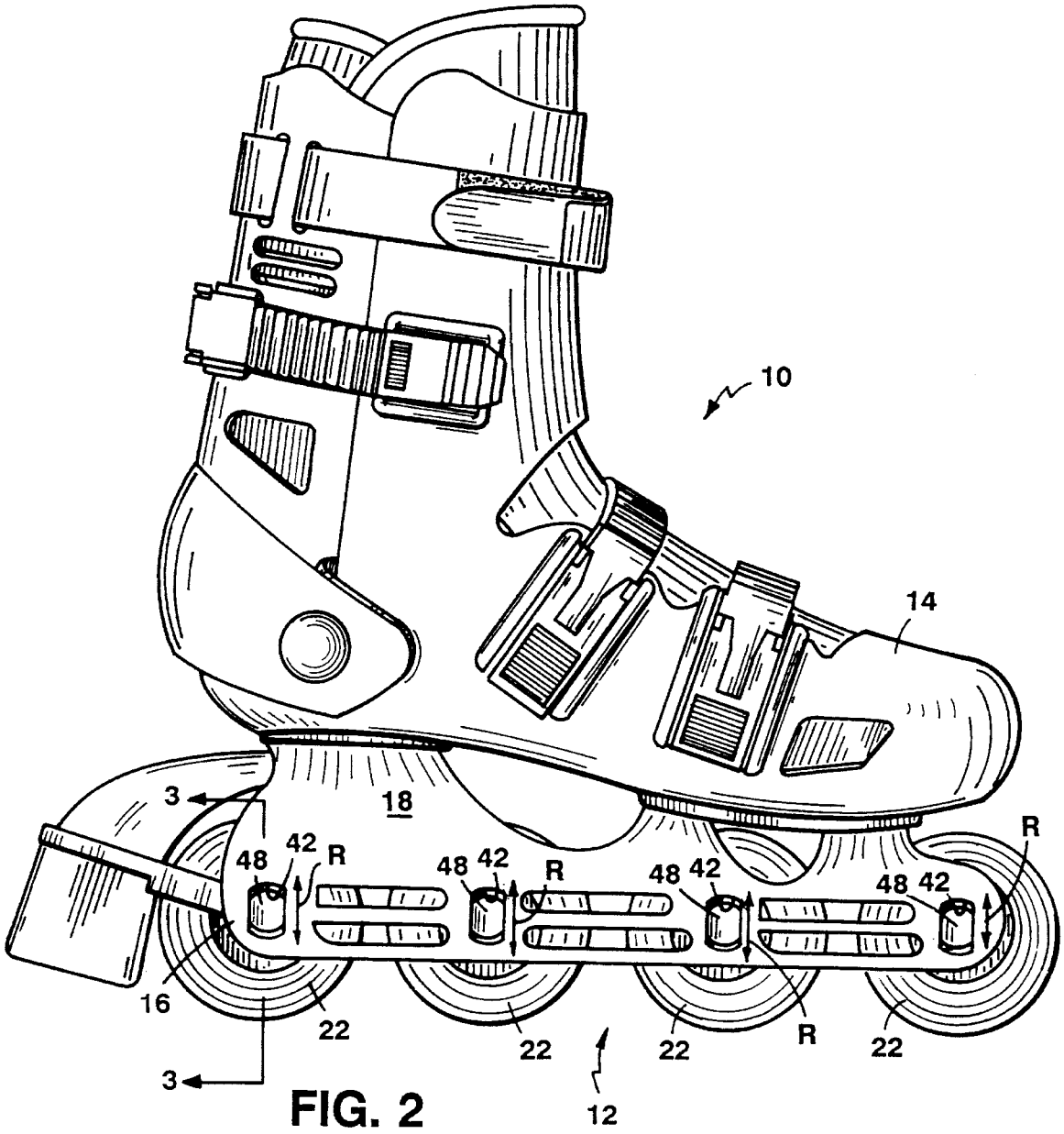
FIG. 2 is a face view of the in-line wheeled skate equipped with a shock absorbing system of FIG. 1.

Referring to FIGS. 1 and 2, an in-line wheeled skate assembly 10 with a shock absorbing system 12 of the invention includes a boot 14 supported upon a skate frame 16 having a pair of opposed, parallel side rails 18, 20. A plurality of wheels 22 are arranged in tandem between the side rails, each wheel mounted upon an axle 24 for rotation about a central axis, W, of the wheel.

Figure 3:
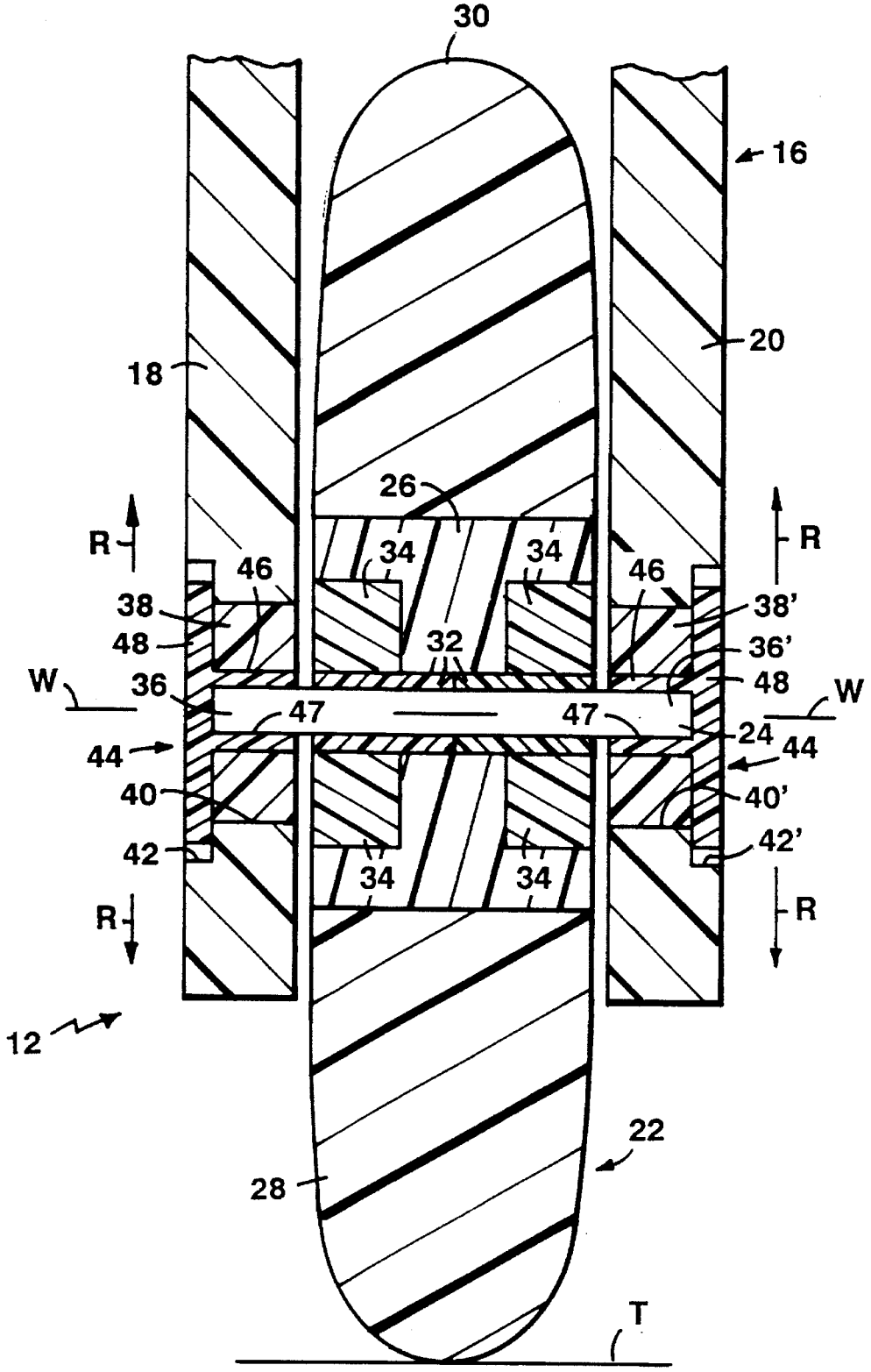
FIG. 3 is a side section view of the in-line wheeled skate equipped with shock absorbing system taken at the line 3—3 of FIG. 2.

Referring also to FIG. 3, each wheel 22 includes a wheel hub 26, a wheel body 28 mounted on the hub and defining a tread 30 for engagement with a travel surface, and inner and outer bearings 32, 34 disposed generally between the hub 22 and the axle 24. Each axle has a first axle end 36 surrounded and supported by a first resilient element 38, which is disposed in a first cushioning aperture 40, defined by the first side rail 18. Each axle also has an opposite, second axle end 36' that is surrounded and supported by a second resilient element 38' disposed in a second cushioning aperture 40', defined by the second side rail 20. In the preferred embodiment, the resilient elements 38, 38' are bushings formed, e.g., of synthetic rubber or other suitable resilient material selected, e.g., on the basis of the weight and ability of the skater, terrain to be travelled and other parameters. Each bushing 38, 38' has the general form of an elongated cylinder with opposite, parallel flats extending axially, for snug fit within the corresponding cushioning apertures 40, 40' of the side rails 18, 20.

Figure 5:
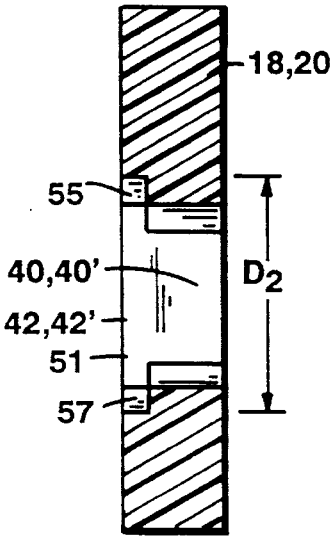
FIG. 5 is a side section view of the frame side wall taken at the line 5—5 of FIG. 4.
Figure 4:
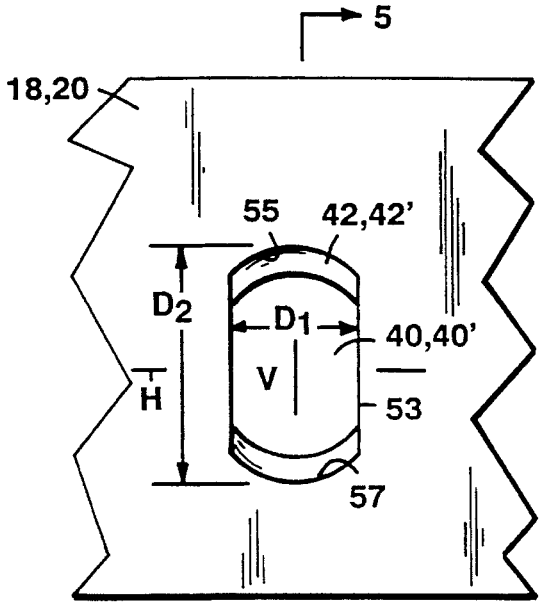
FIG. 4 is a face view of the frame side wall of the in-line wheeled skate equipped with the shock absorbing system of FIG. 1.
Figure 7:
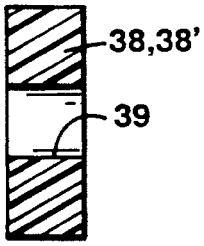
FIG. 7 is a side section view of the resilient cushioning element taken at the line 7—7 of FIG. 6.
Figure 6:
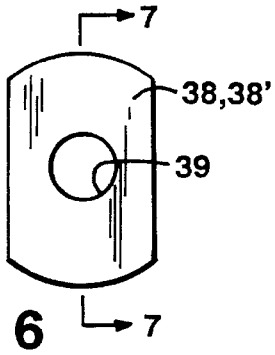
FIG. 6 is a face view of a resilient cushioning element of a shock absorbing system of the invention.

Referring also to FIGS. 4 and 5, each side wall 18, 20 defines a guiding aperture 42, 42' overlapping the respective cushioning aperture 40, 40'. The first axle end 36 extends into the first guiding aperture 42 and the second axle end 36' extends into the second guiding aperture 42'.

Figure 8:
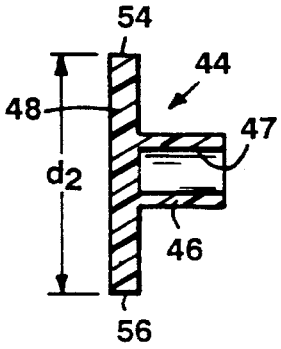
FIGS. 8, 9 and 10 are side, face and rear views, respectively, of an axle end cap.
Figure 9:
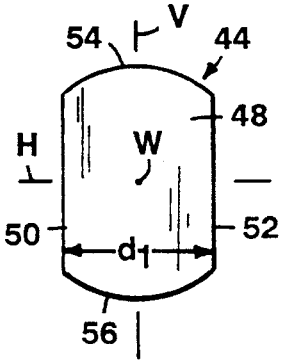
Figure 10:
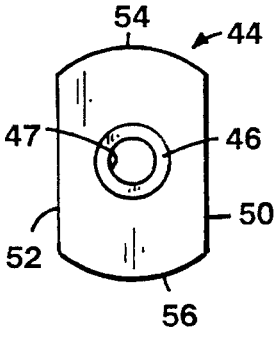

Referring again to FIGS. 3 and 4, and also to FIGS. 8–10, mounted upon each axle end 36, 36' is an end cap 44, formed, e.g., of a suitable hard plastic or metal, consisting of a sleeve 46 received upon the end of the axle, and extending snugly within the bore 39 of the resilient cushions 38, 38', and an integral end cap head 48 extending radially from the sleeve, within the guiding apertures 42, 42'. As shown in particular in FIG. 9, in face view, the end cap head 48 has the general form of a cylinder, with opposite, parallel flats extending axially.

Referring to FIGS. 4 and 5, each guiding aperture 42, 42' has a first aperture dimension, $D_1$, in a first plane, H, of the central axis, W, and a second aperture dimension, $D_2$, in a second plane, V, of the central axis, W. The second plane is generally transverse to the first plane; e.g., in the preferred embodiment, the first plane, H, is generally horizontal and parallel to a surface of travel and the second plane, V, is generally vertical and perpendicular to the first plane.

Referring again to FIGS. 2 and 3, the end cap head 48, disposed within a region of the guiding aperture 42, 42', has a first axle dimension, $d_1$, in first plane, H, and a second axle dimension, $d_2$, in the second plane, V. The first axle dimension, $d_1$, is selected relative to the first aperture dimension, $D_1$, to restrict movement of the axle end 36, 36' in a direction of the first plane, i.e. horizontally, along the direction of travel, with side surfaces 50, 52 of the end cap head 48 disposed for sliding engagement with opposed side surfaces 51, 53 of side rail 18, 20 defining the guiding aperture 42, 42'. The second axle dimension, $d_2$, is selected relative to the second aperture dimension, $D_2$, to permit resilient movement of the end cap head (arrows, R) within the guiding aperture 42, 42', in a direction of the second plane, V, i.e. vertically, in response to bumps and other irregularities in a surface of travel, T. The range of movement of the end cap head 48 in the direction of the second plane, V, is limited by engagement of the top and bottom surfaces 54, 56 of the end cap head 48 with top and bottom surfaces 55, 57 of the guiding aperture 42, 42'.

Referring again to FIGS. 1 and 2, when the shock absorbing system 12 of the invention is assembled with the skate frame 16, the bushings 38, 38' are positioned snugly within the cushioning apertures 40, 40' defined by the side rails 18, 20. The cap insert sleeves 46 are inserted into the bushing bores 39, with the cap insert heads 48 disposed generally within the overlapping guiding apertures 42, 42', also defined by the side rails 18, 20. The opposite ends 36, 36' of the skate wheel axle 24 are secured within the sleeve bore 37 of the respective the end cap insert 44 at each end.

The wheels 22 and axles 24 are thus permitted to move vertically (arrows, R) relative to the side rails 18, 20 (and to the wearer's foot in the boot 12) in response to shock or vibration applied to the wheels by movement over the travel surface, T, while movement of the cap insert sleeve 36 within the bore 39 of the bushing 38, 38' is restrained resiliently, with a cushioning effect, provided by the material of the bushing, thereby to dampen the shock or vibration from reaching the skater.

Other embodiments are within the following claims.

What is claimed is:

1. An in-line wheeled skate, comprising:

a frame having a first side rail and a second side rail opposed and generally parallel to said first side rail, a plurality of wheels arranged in tandem between said first side rail and said second side rail, a plurality of axles, each said axle having a first axle end surrounded and supported by a first resilient element disposed in a first cushioning aperture defined by said first side rail, and each said axle having an opposite, second axle end surrounded and supported by a second resilient element disposed in a second cushioning aperture defined by said second side rail, each one of said plurality of wheels supported upon a corresponding one of said plurality of axles for rotation about a central axis of said wheel, said first side wall defining a first guiding aperture overlapping said first cushioning aperture, said first axle end extending into said first guiding aperture, said first guiding aperture having a first aperture dimension in a first plane of said central axis and a second aperture dimension in a second plane of said central axis transverse to said first plane, said first axle end having a first axle dimension in said first plane and a second axle dimension in said second plane, and said first axle dimension selected relative to said first aperture dimension to restrict movement of said first axle end in a direction of said first plane, and said second axle dimension being selected relative to said second aperture dimension to permit resilient movement of said first axle end in a direction of said second plane, said second side wall defining a second guiding aperture overlapping said second cushioning aperture, said second axle end extending into said second guiding aperture, said second guiding aperture having a first aperture dimension in a first plane of said central axis and a second aperture dimension in a second plane of said central axis transverse to said first plane, said second axle end having a first axle dimension in said first plane and a second axle dimension in said second plane, and said first axle dimension selected relative to said first aperture dimension to restrict movement of said second axle end in said first plane, and said second axle dimension being selected relative to said second aperture dimension to permit resilient movement of said second axle end in said second plane.

2. The in-line wheeled skate of claim 1, wherein said first plane is generally horizontal and generally parallel to a surface of travel.

3. The in-line wheeled skate of claim 1, wherein said second plane is transverse to said first plane.

4. The in-line wheeled skate of claim 3, wherein said second plane is generally vertical and perpendicular to said first plane.

5. The in-line wheeled skate of claim 1, wherein said axle comprises:

a first end cap mounted upon said first axle end, said first end cap comprising a first end cap head defining a surface disposed for engagement with said first side rail in a region of said first guiding aperture, said first end cap head defining said first axle dimension and said second axle dimension, and a second end cap mounted upon said second axle end, said second end cap comprising a second end cap head defining a surface disposed for engagement with said second side rail in a region of said second guiding aperture, said second end cap head defining said first axle dimension and said second axle dimension.

6. The in-line wheeled skate of claim 5, wherein each said end cap comprises a sleeve mounted upon an axle end and said end cap head extending radially from said sleeve.

7. The in-line wheeled skate of claim 6, wherein said end cap head of said end cap has a general form of a cylinder with opposite, parallel flats extending axially, said end cap head disposed generally at an axle end within a region of the guiding aperture.

8. The in-line wheeled skate of claim 1, wherein, for at least one of said first guiding aperture and said second guiding aperture, said second aperture dimension in said second plane is greater than a parallel dimension of a corresponding said cushioning aperture.

9. The in-line wheeled skate of claim 8, wherein at least one of said first guiding aperture and said second guiding aperture is centered about said central axis.

10. The in-line wheeled skate of claim 8, wherein at least one of said first cushioning aperture and said second cushioning aperture is centered about said central axis.

11. The in-line wheeled skate of claim 1, wherein each said resilient element comprises a bushing having a general form of an elongated cylinder with opposite, parallel flats extending axially, a first said bushing being disposed about said first axle end within a region of said first cushioning aperture and a second said bushing being disposed about said second axle end within a region of said second cushioning aperture.

12. The in-line wheeled skate of claim 11, wherein said resilient element is formed of synthetic rubber.

13. The in-line wheeled skate of claim 1, wherein each of said plurality of wheels comprises a wheel hub, a wheel body mounted on said wheel hub and defining a tread for engagement with a travel surface, and one or more bearings disposed generally between said wheel hub and said axle.

14. The in-line wheeled skate of claim 1, wherein, for at least one of said first guiding aperture and said second guiding aperture, said first aperture dimension in said first plane is generally equal to a parallel dimension of a corresponding said cushioning aperture.

15. The in-line wheeled skate of claim 14, wherein at least one of said first guiding aperture and said second guiding aperture is centered about said central axis.

16. The in-line wheeled skate of claim 14, wherein at least one of said first cushioning aperture and said second cushioning aperture is centered about said central axis.

17. The in-line wheeled skate of claim 1, wherein one or more of said first guiding aperture, said second guiding aperture, said first cushioning aperture and said second cushioning aperture is centered about said central axis.

* * * * *